United States Patent [19]

Travis

[11] Patent Number: 4,584,218

[45] **Date of Patent: * Apr. 22, 1986**

[54] WALL ORNAMENT FOR SHOWER AND BATHTUB ENCLOSURES

[76] Inventor: E. Clayton Travis, 4235 Island View Dr., Linden, Mich. 48451

[ * ] Notice: The portion of the term of this patent subsequent to Aug. 20, 2002 has been disclaimed.

[21] Appl. No.: 663,714

[22] Filed: Oct. 22, 1984

Related U.S. Application Data

[63] Continuation-in-part of Ser. No. 641,272, Aug. 16, 1984, Pat. No. 4,536,423.

[51] Int. Cl.[4] ..... B44C 5/04

[52] U.S. Cl. ..... 428/40; 40/594; 428/79; 428/904.4; 428/913.3

[58] Field of Search ..... 40/158 B, 158 R, 159, 40/594; 428/13, 14, 16, 904.4, 913.3, 40, 46

[56] References Cited

U.S. PATENT DOCUMENTS

| | | | |
|---|---|---|---|
| 1,634,333 | 7/1927 | Mock | 428/195 X |
| 2,133,914 | 10/1938 | Burke | 428/79 X |
| 3,380,871 | 4/1968 | Thomas | 428/497 X |
| 3,385,743 | 5/1968 | Backberg | 428/191 |
| 3,463,659 | 8/1969 | Dragoon et al. | 428/454 |
| 3,646,180 | 2/1972 | Winnick | 428/49 X |
| 3,836,420 | 9/1974 | Freese | 428/79 X |
| 4,015,034 | 3/1977 | Smolen | 428/187 X |
| 4,044,405 | 8/1977 | Kreiss | 428/187 X |
| 4,109,326 | 8/1978 | Holt | 428/187 X |
| 4,324,605 | 4/1982 | Bethea | 428/49 X |

FOREIGN PATENT DOCUMENTS

| | | | |
|---|---|---|---|
| 1566273 | 4/1980 | United Kingdom | 156/71 |

*Primary Examiner*—Henry F. Epstein

*Attorney, Agent, or Firm*—Cullen, Sloman, Cantor, Grauer, Scott & Rutherford

[57] ABSTRACT

A wall ornament for shower and tub enclosures comprises a full scale drawing, print or photograph of a male or female or other print of interest, color imprinted upon a sheet of moisture impervious synthetic paper including a film of polypropylene and is die cut closely around its periphery. A layer of pressure sensitive adhesive is bonded to and secured over the rear of the sheet for snug and supportive engagement with the wall of a shower or tub enclosure.

2 Claims, 2 Drawing Figures

WALL ORNAMENT FOR SHOWER AND BATHTUB ENCLOSURES

RELATED APPLICATION

This application is a continuation-in-part application of copending application Ser. No. 641,272, filed Aug. 16, 1984, now U.S. Pat. No. 4,536,423.

BACKGROUND OF THE INVENTION

Heretofore essentially useful articles and shelves or support rods or other devices are mounted upon the wall of a shower or tub enclosure for holding soap, shampoo, brushes, sponges for hanging towels and washcloths and the like.

SUMMARY OF THE INVENTION

The present invention is directed to an aritcle of manufacture such as a novelty wall ornament or poster adapted for mounting upon the wall of a shower or tub enclosure.

An important feature of the present invention is to provide moisture resistant wall ornament for a shower or bathtub enclosure which comprises a full scale photograph or print of a female, male or other form such as images of interest to children, which is die cut throughout its periphery.

A further feature comprises a full scale photograph of a male or female person, imprinted upon a moisture proof synthetic paper which is die cut throughout its periphery.

A further feature includes a layer of pressure sensitive adhesive which overlies and is mounted upon or bonded to the rear of the imprinted sheet adapted for snug supportive securing engagement upon the wall of a shower or bathtub enclosure.

Another feature eliminates the use of a protective water proof enclosure disclosed in the copending application, by imprinting with a moisture resistant ink a design or graphic illustration upon a moisture proof water resistant synthetic paper which includes a film of extruded polypropylene.

These and other features and objects will be seen from the following specification and claims in conjunction with the appended drawing.

THE DRAWING

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Figure 1:
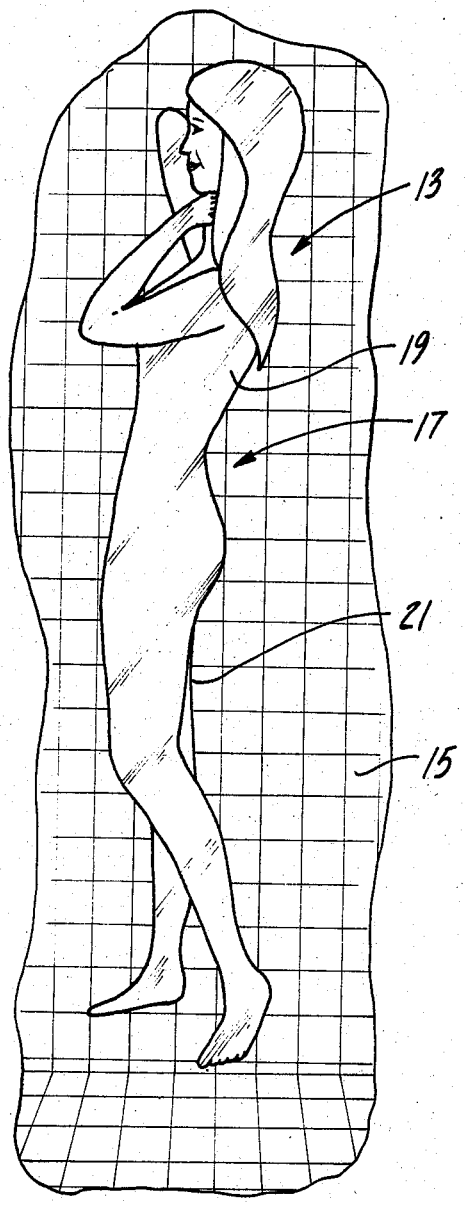
FIG. 1 is a front elevational view of a full scale ornament as mounted upon the wall of a shower or tub enclosure, with the wall and adjacent floor fragmentarily shown.
Figure 2:
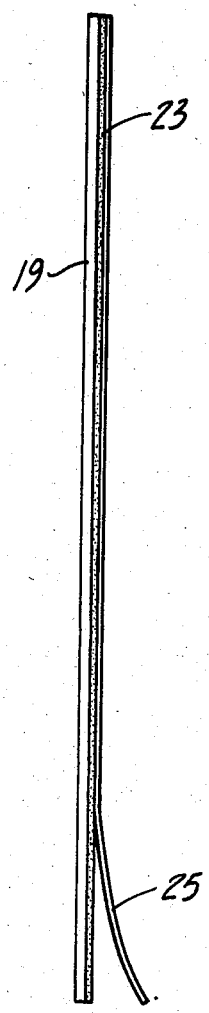
FIG. 2 is a right side elevational view thereof.

Referring to the drawing, the present article of manufacture namely, a wall ornament or poster for a shower or tub enclosure is generally indicated at 13, FIG. 1. Said ornament is adapted for mounting and supporting upon the wall 15 of a shower or bathtub enclosure, fragmentarily shown.

The present poster or wall ornament comprises full scale photograph or drawing 17 of a human form of a male or female, clothed or unclothed, though not limited thereto. The ornament may be a print of an animal or a comic character of interest to children. The completed full scale photo or print is die cut through its periphery defining a peripheral edge 21 surrounding the photo or other image as to provide a real life appearance as though the image is sharing the shower or tub enclosure with the actual occupant.

The photo, drawing or other graphic is imprinted with a special moisture proof, water resistant ink upon a sheet 19 of a synthetic paper which essentially includes an extruded polypropylene film.

The sheet is non-absorbant and highly impervious against penetration by ink, water or other fluids. Its surface is hard and scuff resistant and provides a suitable substrate for imprinting thereon a graphic illustration by off-set printing, silkscreen printing or lithography.

The sheet has a thickness in the range of between 3.8 to 9.9 mills.

This synthetic paper is supplied by Kimberly Clark Corporation and is known by the Trademark KIMDURA.

Special ink formulations are employed for the non-absorbent surface of the paper. Illustrative sources of such ink compositions are one or more of the following:

1. Sinclair and Valentine of Atlanta, Georgia and Dayton, Ohio.
2. Croda Ink of Atlanta.
3. Borden, Inc. of Lakeland, Fla.
4. Inmont Ink Company.

For silk-screening ink supplier may be Advance, Inc., and Nezdar, Ink.

For flexographic inks, American Graphic Supply Company of Atlanta, Georgia provides a number of water based inks.

A layer 23 or pressure sensitive adhesive is mounted and secured upon and overlies the back of sheet 19. The adhesive surface is adapted for manual pressure and securing engagement with wall 15 of a shower or tub enclosure, fragmentarily shown in FIG. 1. The pressure sensitive layer 23 is normally covered before use with a separable protective paper sheet 25. The imprinted sheet 19 is die cut as at 21 and with the protective sheet 25 removed, is snugly applied to wall 15 by manual pressure so that the wall ornament is in snug supported surface engagement with said wall.

The present invention is directed to a novelty poster or wall ornament. The photo or print could be a nude male or female providing the user with a choice of a shower or tub companions. The poster may be the image of a person taking a shower or a tub companion for children. The ornamental waterproof poster may be used in hot tub, jacuzzi or sauna.

The synthetic paper employed such as sheet 19, FIG. 1, is moisture proof, non-absorbent to moisture and is water proof as is also the special ink employed for imprinting the present design 17. Normally the special color ink employed has no more than 3% of a petroleum distilate.

The synthetic paper is highly impervious to penetration of ink or water. Its surface is hard and provides a very suitable substrate for color imprinting of a particular selected design which stays only upon the surface of the synthetic paper sheet. The reasonably stiff synthetic paper has a high gloss and is essentially an extruded polypropylene film. The wall ornament is water resistant and substantially permanent when glued or otherwise adhered to a wall surface.

It is contemplated that there may be a top coating of nitrocellulose lacquer or a urethane coating applied to the imprinted sheet to provide a sheet which is scratch and scuff resistant.

Having described my invention, reference should now be had to the following claims:

I claim:

1. As an article of manufacture, a waterproof ornamental poster for attachment to a vertical building wall of a tub or shower enclosure, comprising:

an enlarged substantially full scale, full size photograph of a person or other image imprinted upon a sheet of impervious moisture resistant synthetic paper, said sheet including an extruded polypropylene film;

the contours of said image being die cut generally along its periphery, defining a contoured outer peripheral edge;

a layer of pressure sensitive material mounted on and overlying one side of said sheet along its length for engagement with said wall;

and a strippable protective sheet mounted upon the adhesive layer;

said imprinted sheet on removal of said protective sheet being adapted for engagement with the building wall of a shower or bathtub enclosure, retaining said ornamental poster in snug supported surface engagement therewith along its length.

2. In the wall ornament of claim 1, a scratch resistant urethane coating bonded to and overlying the imprinted sheet.

* * * * *